US006203397B1

(12) United States Patent
Applewhite et al.

(10) Patent No.: US 6,203,397 B1
(45) Date of Patent: Mar. 20, 2001

(54) CONVERTIBLE AIR AND WATER TOY GUN

(75) Inventors: John T. Applewhite, Smyrna; Jeffrey Shane Matthews, Atlanta, both of GA (US)

(73) Assignee: Johnson Research & Development & Company, Inc., Smyrna, GA (US)

( * ) Notice: Subject to any disclaimer, the term of this patent is extended or adjusted under 35 U.S.C. 154(b) by 0 days.

(21) Appl. No.: 09/444,726

(22) Filed: Nov. 19, 1999

(51) Int. Cl.[7] ..... A63H 33/30; A63H 29/10

(52) U.S. Cl. ..... 446/475; 446/15; 446/176

(58) Field of Search ..... 446/15, 20, 397, 446/405, 406, 483, 176, 211; 124/56, 58, 59, 63; 222/78, 79

(56) References Cited

U.S. PATENT DOCUMENTS

| | | |
|---|---|---|
| D. 78,206 | 4/1929 | Hermann . |
| D. 159,040 | 6/1950 | Bicos . |
| D. 191,686 | 10/1961 | Johnson et al. . |
| D. 200,473 | 3/1965 | Sawyer . |
| D. 265,221 | 6/1982 | Hardin . |
| D. 285,327 | 8/1986 | Yano . |
| D. 297,748 | 9/1988 | Marino . |
| D. 303,820 | 10/1989 | Wong . |
| D. 318,309 | 7/1991 | D'Andrade . |
| D. 336,939 | 6/1993 | Salmon et al. . |
| D. 338,697 | 8/1993 | Salmon et al. . |
| D. 340,750 | 10/1993 | Salmon et al. . |
| D. 341,174 | 11/1993 | Salmon et al. . |
| D. 341,396 | 11/1993 | Salmon et al. . |
| 1,713,432 | 5/1929 | Griggs . |
| 1,964,345 | 6/1934 | Feller . |
| 2,023,124 | 12/1935 | Dickover . |
| 2,049,194 | 7/1936 | Chapin et al. . |
| 2,147,003 | 2/1939 | Von Kozurik . |
| 2,303,510 | 12/1942 | Swebilius . |
| 2,312,244 | 2/1943 | Feltman . |
| 2,357,951 | 9/1944 | Hale . |
| 2,409,653 | 10/1946 | Amdur . |
| 2,505,428 | 4/1950 | Pope . |
| 2,589,977 | 3/1952 | Stelzer . |
| 2,654,973 | 10/1953 | Lemelson . |
| 2,733,699 | 2/1956 | Krinsky . |
| 2,927,398 | 3/1960 | Kaye et al. . |
| 3,005,495 | 10/1961 | Herberg . |
| 3,025,633 | 3/1962 | Kaye et al. . |
| 3,049,832 | 8/1962 | Joffe . |
| 3,121,292 | 2/1964 | Butler et al. . |
| 3,163,330 | 12/1964 | Ryan . |
| 3,197,070 | 7/1965 | Pearl et al. . |
| 3,218,755 | 11/1965 | Quercetti . |
| 3,273,553 | 9/1966 | Doyle . |
| 3,308,803 | 3/1967 | Walther . |
| 3,397,476 | 8/1968 | Weber . |
| 3,415,010 | 12/1968 | Belz . |
| 3,510,980 | 5/1970 | Pippin, Jr. . |
| 3,794,789 | 2/1974 | Bynum . |

(List continued on next page.)

FOREIGN PATENT DOCUMENTS

2587991 A1 10/1985 (FR) .

*Primary Examiner*—Jacob K. Ackun
*Assistant Examiner*—Faye Francis
(74) *Attorney, Agent, or Firm*—Kennedy, Davis & Hodge

(57) ABSTRACT

A toy gun (10) is provided having a housing (11), a barrel (12), a trigger (13), and a manual air pump (14). The manual air pump is coupled to both a water pressure tank (15) and an air pressure chamber (30). The water pressure tank is coupled to a quick release water nozzle or valve (24). The air pressure chamber is coupled to a quick release air valve (32). The trigger is coupled to a movable switch (40) which selectively engages either the quick release water nozzle to release a stream of water with actuation of the trigger or the quick release air valve to release a burst of compressed air with actuation of the trigger.

16 Claims, 4 Drawing Sheets

U.S. PATENT DOCUMENTS 3,878,827 4/1975 Newgarde, Jr. .
3,943,656 3/1976 Green .
3,962,818 6/1976 Pippin .
4,004,566 1/1977 Fischer .
4,022,350 5/1977 Amron .
4,073,282 2/1978 Koehn .
4,083,349 4/1978 Clifford .
4,159,705 7/1979 Jacoby .
4,160,513 7/1979 Cockerham .
4,214,674 7/1980 Jones et al. .
4,223,472 9/1980 Feket et al. .
4,239,129 12/1980 Esposito .
4,411,249 10/1983 Fogarty et al. .
4,441,629 4/1984 Mackal .
4,466,213 8/1984 Alberico et al. .
4,509,659 4/1985 Cloutier et al. .
4,591,071 5/1986 Johnson .
4,687,455 8/1987 Sculatti .
4,706,848 11/1987 D'Andrade .
4,735,239 4/1988 Salmon et al. .
4,743,030 5/1988 Auer et al. .
4,750,641 6/1988 Hun .
4,757,946 7/1988 Johnson .
4,819,609 4/1989 Tippmann .
4,848,307 7/1989 Tsao .
4,854,480 8/1989 Shindo .
4,875,508 10/1989 Burke, II et al. .
4,890,767 1/1990 Burlison .
4,897,065 1/1990 Fertig et al. .
4,928,661 5/1990 Bordt et al. .
4,955,512 9/1990 Sharples .
5,029,732 7/1991 Wong .
5,074,437 12/1991 D'Andrade et al. .
5,090,708 2/1992 Gerlitz et al. .
5,097,816 3/1992 Miller .
5,097,985 3/1992 Jones .
5,150,819 9/1992 Johnson et al. .
5,155,310 10/1992 Goans .
5,184,755 2/1993 Brovelli .
5,184,756 2/1993 Amron .
5,188,557 2/1993 Brown .
5,229,531 7/1993 Song .
5,238,149 8/1993 Johnson et al. .
5,241,944 9/1993 Rappaport .
5,244,153 9/1993 Kuhn et al. .
5,280,778 1/1994 Kotsiopoulos .
5,280,917 1/1994 Ortiz .
5,339,791 8/1994 Sullivan .
5,339,987 8/1994 D'Andrade .
5,343,849 9/1994 Steer .
5,343,850 9/1994 Steer .
5,349,938 9/1994 Farrell .
5,370,278 12/1994 Raynie .
5,373,832 12/1994 D'Andrade .
5,373,833 * 12/1994 D'Andrade ..... 124/69
5,381,928 1/1995 Lee et al. .
5,398,873 3/1995 Johnson et al. .
5,413,514 5/1995 Milligan .
5,415,152 5/1995 Adamson et al. .
5,433,646 7/1995 Tarng .
5,448,984 9/1995 Brovelli .
5,450,839 9/1995 Nicolaevich et al. .
5,471,968 12/1995 Lee .
5,497,758 3/1996 Dobbins et al. .
5,515,837 5/1996 Nin et al. .
5,529,050 6/1996 D'Andrade .
5,553,598 9/1996 Johnson et al. .
5,603,361 * 2/1997 Cuisinier ..... 222/79
5,605,140 2/1997 Griffin .
5,613,483 3/1997 Lukas et al. .
5,660,159 * 8/1997 Clayton ..... 124/66
5,673,679 10/1997 Walters .
5,701,879 12/1997 Johnson et al. .
5,704,342 1/1998 Gibson et al. .
5,722,383 3/1998 Tippman, Sr. et al. .
5,769,066 6/1998 Schneider .
5,771,875 6/1998 Sullivan .
5,794,606 8/1998 Deak .
5,816,232 10/1998 Bell .
5,826,750 10/1998 Johnson .
5,865,344 2/1999 Nagel .
5,878,734 3/1999 Johnson et al. .
5,878,735 * 3/1999 Johnson ..... 124/59
5,906,295 5/1999 D'Andrade .

* cited by examiner

CONVERTIBLE AIR AND WATER TOY GUN

TECHNICAL FIELD

This invention relates to toy guns, and specifically to compressed air guns and water guns.

BACKGROUND OF THE INVENTION

Toy guns which shoot or launch projectiles have been very popular for many years. These guns have been designed to launch projectiles in a number of ways. A common method of launching projectiles has been by the compression of a spring which propels the projectile upon its decompression or release, as, for example, with BB guns and dart guns. These guns however usually do not generate enough force to launch projectiles with great velocity.

Toy guns have also been designed which use compressed air to launch projectiles such as foam darts. These types of guns use a reciprocating air pump to pressurize air within a pressure tank.

Toy guns have also been designed which produce a stream of water and hence are commonly referred to as water guns. Because these guns dispose water they are typically used outdoors. These guns have been designed to eject the stream of water in a number of ways. The most simple method of ejecting water has been by the actuation of a manual pump coupled to the trigger of the gun. The pump is actuated by the mere pressure exerted by one finger of an operator upon the trigger, thus the pump typically cannot generate enough pressure to eject the water a lengthy distance. Additionally, these types of pumps work on the actuation of a compression piston which create single, short bursts of water. However, many children desire the production of an extended stream of water.

Water guns have also been designed with small electric pumps which expel a stream of water from a tube coupled to the pump, as shown in U.S. Pat. Nos. 4,706,848 and 4,743,030. However, these small electric pumps typically do not generate enough force to eject the stream of water a lengthy distance.

Water guns have also been designed to include a pressure tank in which stored water is pressurized with the use of compressed air. As with all water gun, these guns do not launch projectiles, an action potentially desirous of children.

Heretofore, children desirous of obtaining a toy gun have had to choose between an air gun which launched projectiles and are therefore used primarily indoors and a water gun which is used outdoors. The only alternative to this has been the purchase of both an air gun and a water gun.

Accordingly, it is seen that a need remains for a toy gun which may be utilized as an air gun and also a water gun to prevent the purchase of both types of toy guns and to provide a dynamic conversion and actuation between firing projectiles and firing streams of water. It is to the provision of such therefore that the present invention is primarily directed.

SUMMARY OF THE INVENTION

In a preferred form of the invention a toy gun comprises pressurized air means for providing a supply of pressurized air, a water pressure tank in fluid communication with the pressurized air means, a water release valve in fluid communication with the water pressure tank, an air pressure chamber in fluid communication with the pressurized air means, an air release valve in fluid communication with the air pressure chamber, and trigger means for selective actuation of the water release valve and the air release valve. With this construction, an operator of the toy gun may choose between firing a compressed air or pressurized water from the toy gun.

DETAILED DESCRIPTION

Figure 1:
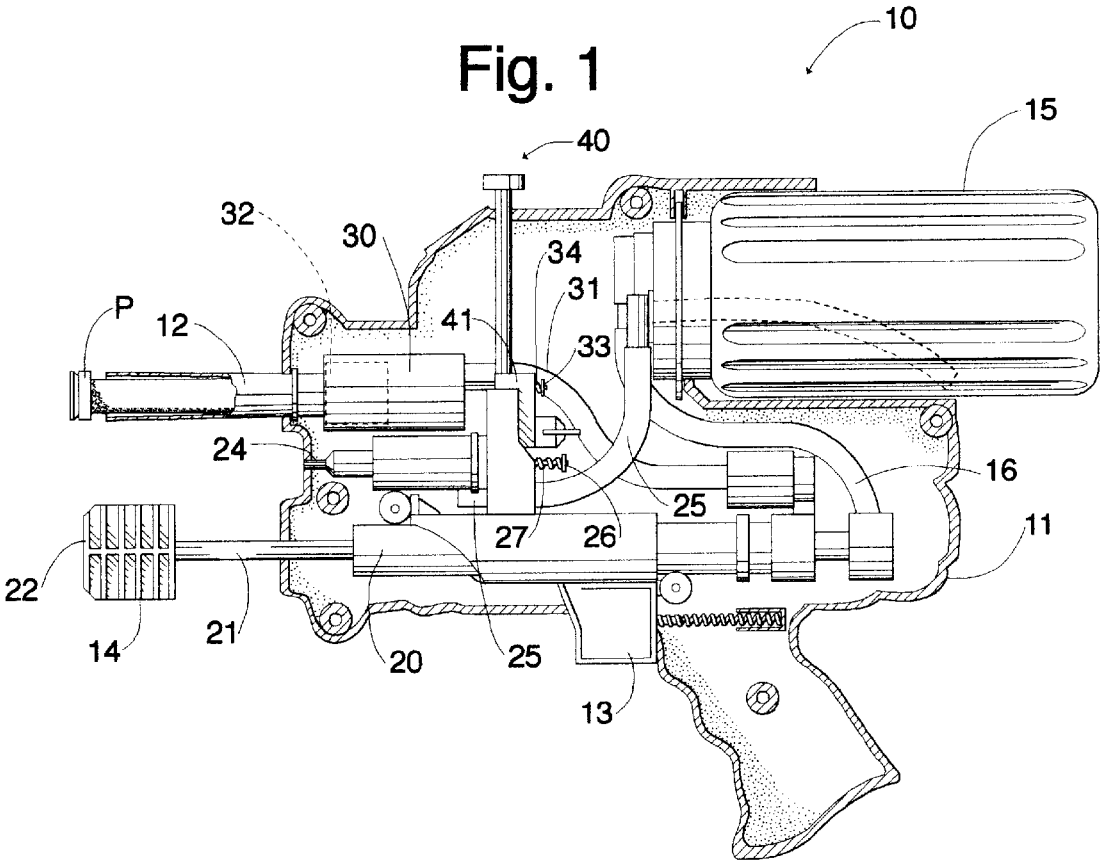
FIG. 1 is a schematic view of a compressed air/water gun embodying principles of the present invention in a preferred form, shown in a position to fire a compressed air projectile.

With reference next to the drawings, there is shown a compressed toy air gun 10 having a stock or housing 11, a barrel 12 extending from to the stock 11, a spring biased trigger 13, and a manual air pump 14. The gun 10 has a water pressure tank 15 in fluid communication with the air pump 14 through a pressure tube 16.

The pump 14 includes a conventional cylinder 20, a cylinder rod or plunger 21 and a handle 22 mounted to an end of the cylinder rod 21. The pressure tank 15 is coupled to a quick release nozzle or valve 24 through a water line 25. The quick release water nozzle 24 has a central firing pin 26 having a spring 27 and a sliding engagement plate 28 thereon adapted to bias the firing pin 26 towards a water releasing position. This type of quick release water nozzle is similar to that shown in U.S. Pat. No. b 5,906,295which is specifically incorporated herein.

The gun 10 also has an air pressure chamber 30 in fluid communication with the air pump 14 through an air line 31. The air pressure chamber 30 has a quick release valve 32 having a central firing pin 33 with a spring 34 and a sliding engagement plate 35 thereon adapted to bias the firing pin 33 towards an air releasing position. The release valve is similar to that shown in U.S. Pat. No. 5,373,833, which is specifically incorporated herein, and similar to the water release valve 24. The pressure chamber 30 is in fluid communication with the barrel 12 adapted to hold a conventional projectile P, such as a foam dart.

Figure 2:
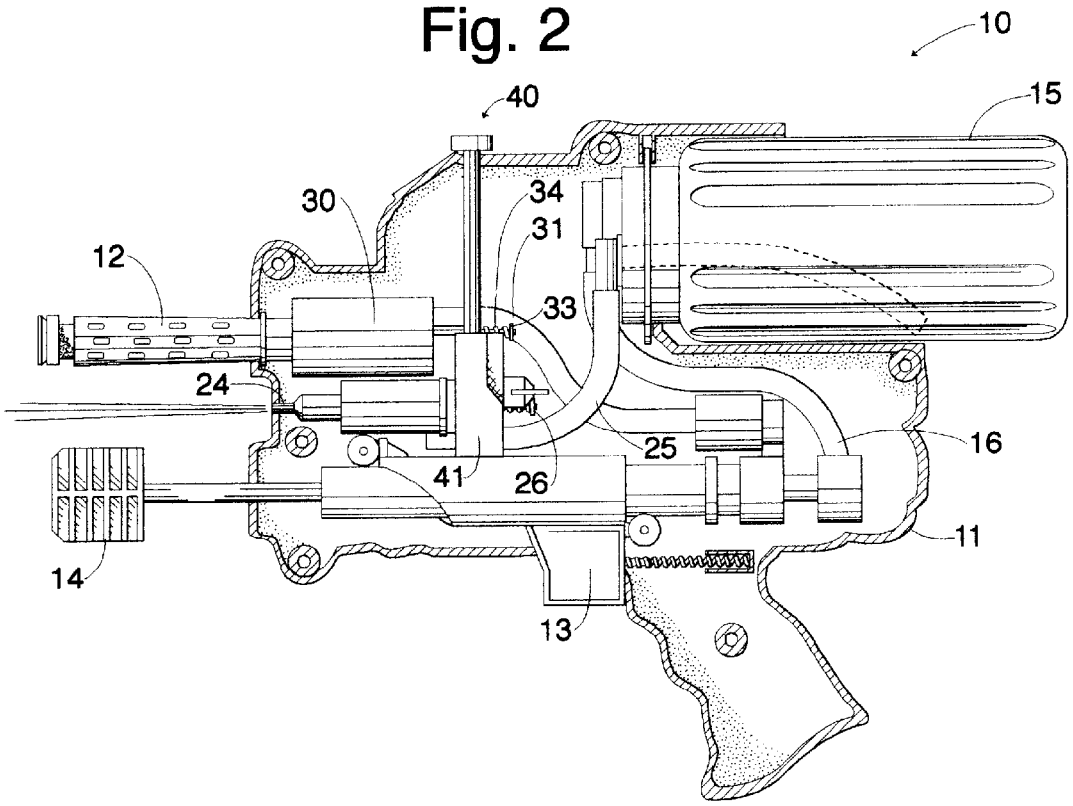
FIG. 2 is a schematic view of the air/water gun of FIG. 1 shown in a position to fire water.
Figure 6:
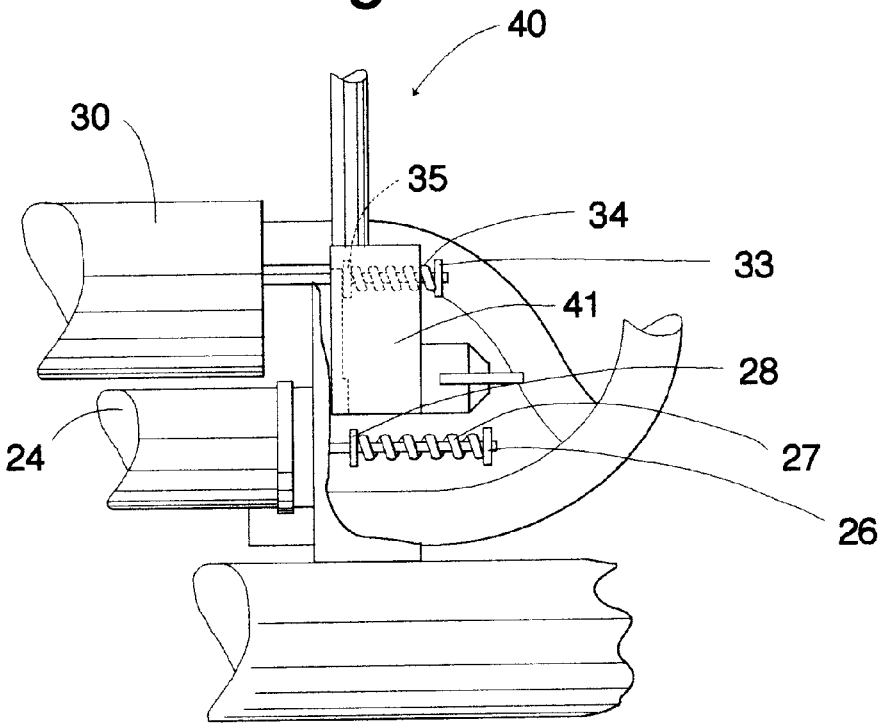
FIG. 6 is a detailed view of the switching mechanism on the gun of FIG. 1.
Figure 7:
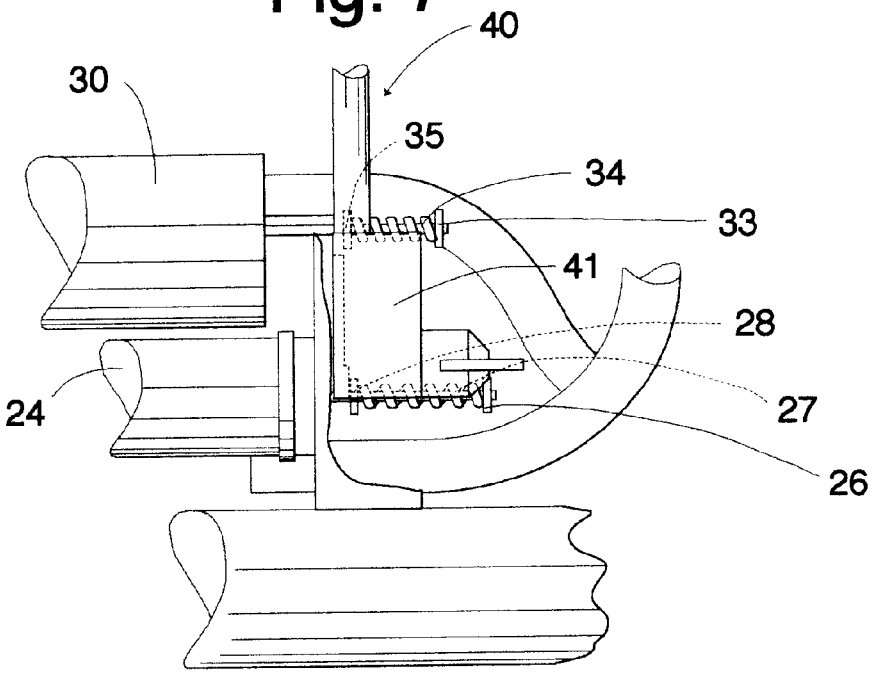
FIG. 7 is a detailed view of the switching mechanism on the gun of FIG. 2.

Lastly, the gun includes a switch 40 which is movable between an air firing position, shown in FIGS. 1 and 6, and a water firing position, shown in FIGS. 2 and 7. The switch 40 includes a slide 41 which engages trigger 13. With the switch 40 in its air firing position the slide 41 engages the firing pin 33 of the air release valve 32 but not the firing pin 26 of the water release nozzle 24 upon actuation of the trigger. With the switch 40 in its water firing position the slide 41 engages the firing pin 26 of the water release nozzle 24 but not that of the air release valve 32.

In use, an operator fills the pressure tank 15 with a supply of water in a conventional manner. The operator then actuates the pump 14 to pressurize a supply of air by grasping the handle 22 and reciprocating the cylinder rod 21 back and forth within the cylinder 20. Pressurized air is passed through pressure tube 16 into the water pressure tank 15 thereby pressurizing the supply of water therein. Simultaneously, air from the air pump 14 is also passed through pressure air line 31 into the air pressure chamber 30, thereby pressuring a supply of air within the pressure chamber 30.

The operator may then decide whether to fire the projectile with the use of compressed air within the air pressure chamber 30 or to fire a stream of water from water nozzle 24. Should the operator choose to fire the projectile, the switch 40 is positioned to its air firing position wherein the slide 41 contacts engagement plate 35 of the air pressure chamber release valve 32. Manual actuation of the trigger 13 moves the engagement plate 35 along the firing pin 33 until the compression force of the spring 34 overcomes the air pressure within the air pressure chamber preventing rearward movement of the firing pin 33. Upon reaching this overcoming force the spring 34 causes the rapid movement of the firing pin 33 to its firing position resulting in the rapid release of the compressed air within the air pressure chamber 30 into the barrel 12. The flow of air into the barrel 12 causing the deployment of the projectile P therein.

Alternatively, should the operator choose to fire a stream of water the switch 40 is positioned to its water firing position wherein the slide 41 contacts engagement plate 28 of the water nozzle 24. Manual actuation of the trigger 13 moves the engagement plate 28 along the firing pin 26 until the compression force of the spring 27 overcomes the water pressure preventing rearward movement of the firing pin 26. Upon reaching this force the spring 27 causes the rapid movement of the firing pin 26 to its firing position, and thus the release of the pressurized water from the water nozzle 24.

It should be understood that as the actuation of the air pump 14 causes the simultaneous pressurization of both the water within the pressure tank 15 and the pressurization of air within the air pressure chamber 30. The operator may then choose the firing of compressed air projectiles or the firing of water at any time. Furthermore, the operator may fire either the water or air and then immediately fire the alternatively remaining water or air, as each firing is independent of the other. Of course, the operator may also choose to utilize the gun solely as a water gun or solely as a compressed air gun by maintaining the switch in one position.

Figure 3:
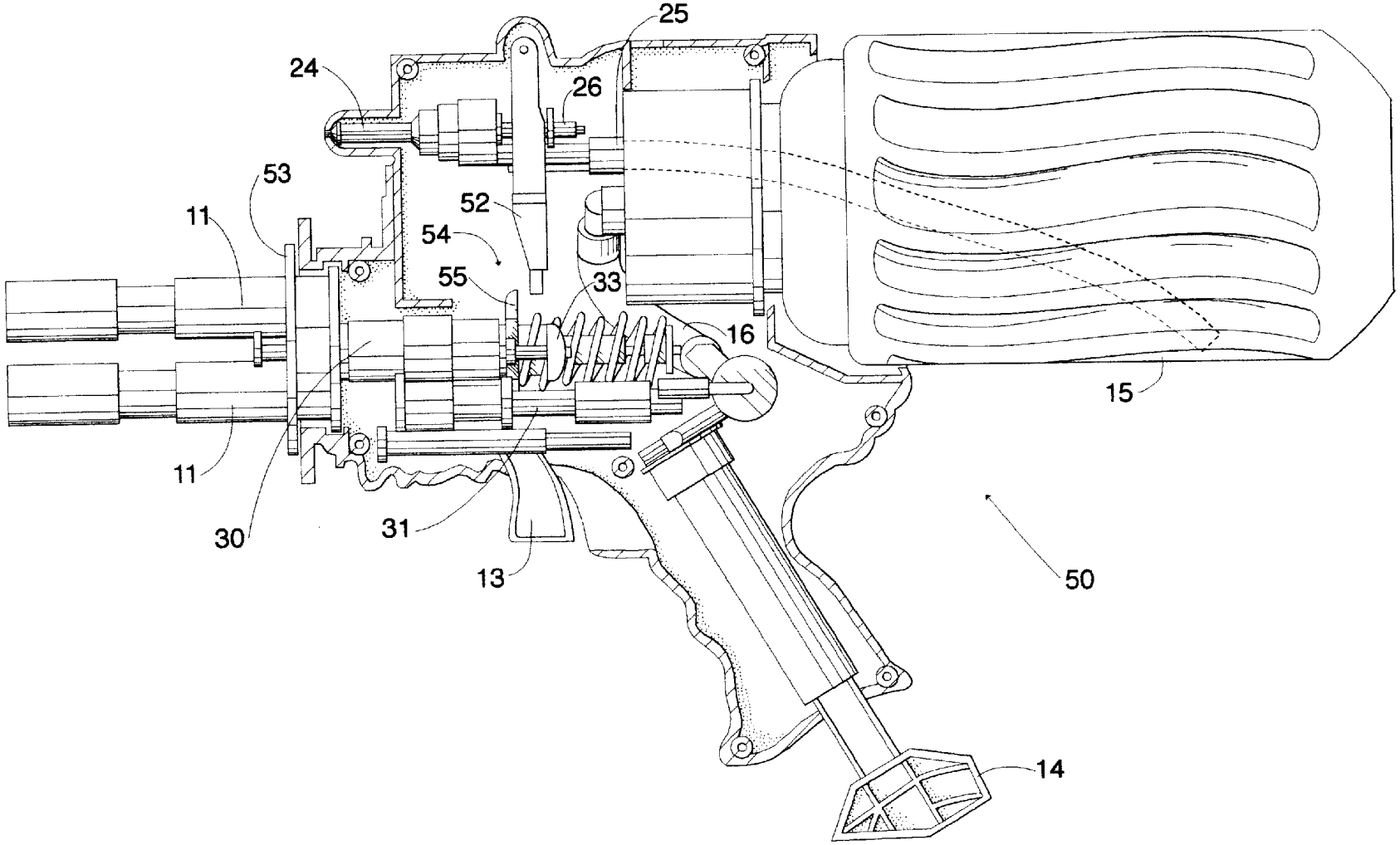
FIG. 3 is a schematic view of an air/water gun in another preferred form of the invention.
Figure 4:
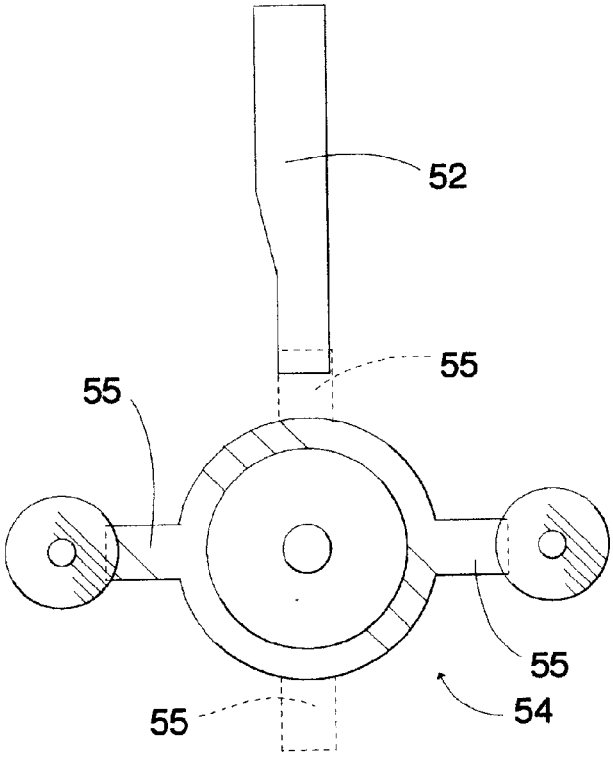
FIG. 4 is an end view of the air release valves and triggering mechanism of the gun of FIG. 3.

With reference next to FIG. 3, there is shown a toy gun 50 in another preferred form. Here, the toy gun 50 also includes a rotating magazine 53 which is designed to hold a plurality of projectiles and a nozzle engaging finger 52 coupled to the water nozzle 24. Furthermore, the switching mechanism 54 is directly coupled to the magazine so that rotation of the magazine, as best shown in FIG. 4, causes the slide or catch 55 to rotate between a position engaging the air release valves 32 and a position engaging the water nozzle 24 which is shown in phantom lines. As such, the rotational position of the magazine determines the intended use of the gun.

Figure 5:
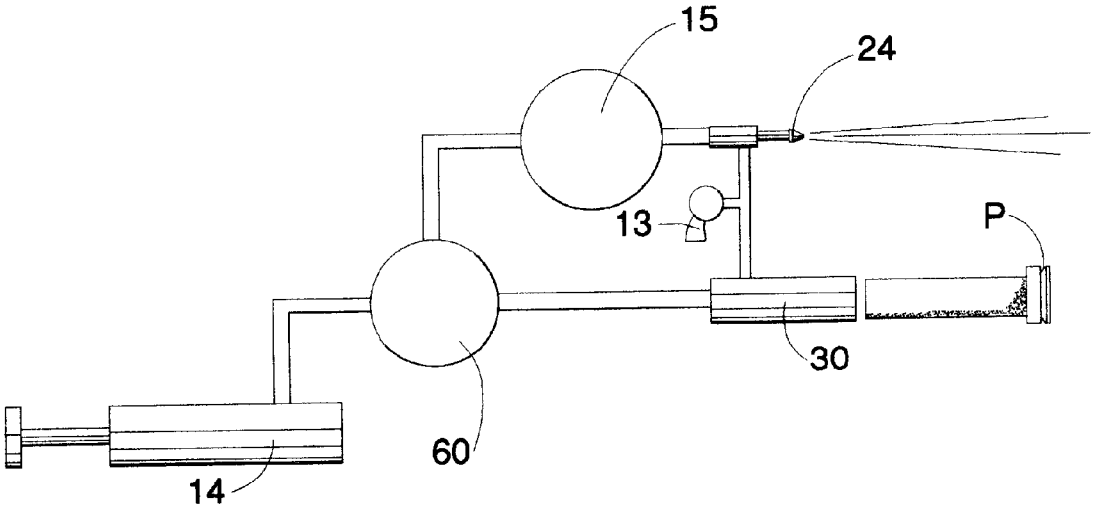
FIG. 5 is a schematic view of an air pressure tank which may be adapted to the gun of FIG. 1 or FIG. 3.

It should also be understood that other types of conventionally known fluid release valves may be used as an alternative to that shown. Such alternatives include pressure sensitive release valves such as that shown in U.S. Pat. No. 5,878,735. Lastly, it should be understood that an additional pressure tank 60 may be used alone or in addition to the air pump to supply pressurized air to the water pressure tank 15 and air pressure chamber 30, as shown in FIG. 5. This would enable the gun to be fired several times between manual actuations of the air pump, such as that shown in U.S. Pat. No. 5,878,735 which is specifically incorporated herein. Also, other types of air pumps, such a motorized air pump, may be used as an alternative to the manual air pump of the preferred embodiments.

While this invention has been described in detail with particular reference to the preferred embodiments thereof, it should be understood that many modifications, additions and deletions, in addition to those expressly recited, may be made thereto without departure from the spirit and scope of invention as set forth in the following claims.

What is claimed is:

1. A toy gun comprising:

pressurized air means for providing a supply of pressurized air;

a water pressure tank in fluid communication with said pressurized air means;

a water release valve in fluid communication with said water pressure tank;

an air pressure chamber in fluid communication with said pressurized air means;

an air release valve in fluid communication with said air pressure chamber; and trigger means for selective actuation of said water release valve and said air release valve, whereby an operator of the toy gun may choose between firing a compressed air or pressurized water from the toy gun.

2. The toy gun of claim 1 further comprising a projectile launch tube in fluid communication with said air release valve.

3. The toy gun of claim 1 wherein said pressurized air means comprises an air pump.

4. The toy gun of claim 3 further comprising an air pressure tank in fluid communication with said water pressure tank and said air pressure chamber.

5. The toy gun of claim 1 wherein said trigger means comprises a movable trigger and a switch coupled to said movable trigger, said switch being movable between a first position engaging said air release valve and a second position engaging said water release valve.

6. The toy gun of claim 1 further comprising a rotatable magazine having a plurality of launch tubes.

7. The toy gun of claim 6 wherein said trigger means comprises a movable trigger and a catch coupled to said magazine which is selectively engagable with said air release valve and said water release valve, whereby the rotational position of the magazine determines the selective actuation of the air release valve or water release valve.

8. A toy gun comprising:

an air pump;

a water pressure tank in fluid communication with said air pump;

a water nozzle in fluid communication with said water pressure tank;

an air pressure chamber in fluid communication with said air pump; and means for selectively releasing pressurized air from said air pressure chamber and pressurized water from said nozzle of said water pressure tank, whereby an operator may release a burst of pressurized air or a stream of pressurized water from the toy gun through actuation of the selective releasing means.

9. The toy gun of claim 8 wherein said selectively releasing means includes an air release valve in fluid communication with said air pressure chamber, a water release valve in fluid communication with said water pressure tank and a trigger couplable to said air release valve and said water release valve.

10. The toy gun of claim 9 wherein said selectively releasing means further comprises switch means for alternative selection of engagement between said trigger and said air release valve or between said trigger and said water release valve.

11. The toy gun of claim 8 further comprising a projectile launch tube in fluid communication with said air pressure tank.

12. The toy gun of claim 8 further comprising an air pressure tank in fluid communication with said air pump and said water pressure tank.

13. The toy gun of claim 8 further comprising an air pressure tank in fluid communication with said air pump and said air pressure chamber.

14. The toy gun of claim 13 wherein said air pressure tank is also in fluid communication with said water pressure tank.

15. The toy gun of claim 8 further comprising a rotatable magazine having a plurality of launch tubes.

16. The toy gun of claim 15 wherein said selective releasing means comprises a movable trigger and a catch coupled to said magazine which is selectively engagable with an air release valve in fluid communication with said air pressure chamber and selectively engagable with a water release valve in fluid communication with said water pressure tank, whereby the rotational position of the magazine determines the selective actuation of the air release valve or water release valve.

* * * * *